US011336987B2

(12) United States Patent
Liu et al.

(10) Patent No.: US 11,336,987 B2
(45) Date of Patent: May 17, 2022

(54) METHOD AND DEVICE FOR DETECTING WEARING STATE OF EARPHONE AND EARPHONE

(71) Applicant: Beijing Xiaoniao Tingting Technology Co., LTD, Beijing (CN)

(72) Inventors: Song Liu, Beijing (CN); Bo Li, Beijing (CN); Na Li, Beijing (CN)

(73) Assignee: Beijing Xiaoniao Tingting Technology Co., LTD., Beijing (CN)

( * ) Notice: Subject to any disclaimer, the term of this patent is extended or adjusted under 35 U.S.C. 154(b) by 0 days.

(21) Appl. No.: 16/881,552

(22) Filed: May 22, 2020

(65) Prior Publication Data

US 2020/0374617 A1 Nov. 26, 2020

(30) Foreign Application Priority Data

May 23, 2019 (CN) ..... 201910436304.5

(51) Int. Cl.
*H04R 3/04* (2006.01)
*H04R 1/10* (2006.01)
*H04R 29/00* (2006.01)

(52) U.S. Cl.
CPC ..... *H04R 1/1041* (2013.01); *H04R 1/1016* (2013.01); *H04R 3/04* (2013.01); *H04R 29/001* (2013.01)

(58) Field of Classification Search
CPC ..... H04R 1/1041; H04R 1/1016; H04R 3/04; H04R 1/10; H04R 5/033
USPC ..... 381/370–371, 376, 380, 74
See application file for complete search history.

(56) References Cited

U.S. PATENT DOCUMENTS

| | | | | |
|---|---|---|---|---|
| 9,894,452 | B1 | 2/2018 | Termeulen et al. | |
| 10,244,306 | B1 * | 3/2019 | Ku | G10K 11/17833 |
| 10,341,766 | B1 * | 7/2019 | Dyrholm | G10L 25/78 |
| 10,748,521 | B1 * | 8/2020 | Mulvey | G10K 11/17881 |
| 10,885,896 | B2 * | 1/2021 | Ku | H04R 1/1083 |
| 2010/0074451 | A1 | 3/2010 | Usher et al. | |
| 2012/0207319 | A1 * | 8/2012 | Tsuchiya | H03G 5/165 381/74 |
| 2013/0279724 | A1 * | 10/2013 | Stafford | H04R 5/04 381/309 |
| 2014/0037101 | A1 | 2/2014 | Murata et al. | |

(Continued)

FOREIGN PATENT DOCUMENTS

EP 3089475 A1 11/2016

OTHER PUBLICATIONS

European Search Report dated Oct. 8, 2020 in corresponding European Patent Application No. 20176014.7.

*Primary Examiner* — Disler Paul
(74) *Attorney, Agent, or Firm* — Syncoda LLC; Feng Ma

(57) ABSTRACT

A method and device for detecting a wearing state of an earphone and an earphone are disclosed. The method includes that: a source audio signal input into a loudspeaker of an earphone and a feedback audio signal collected by a prepositive microphone are acquired; a transfer function between the source audio signal and the feedback audio signal is acquired according to the source audio signal and the feedback audio signal; and a wearing state of the earphone is acquired according to the transfer function, and audio compensation processing is performed on the source audio signal according to the wearing state.

9 Claims, 10 Drawing Sheets

(56) References Cited

U.S. PATENT DOCUMENTS

| | | | | |
|---|---|---|---|---|
| 2015/0055788 | A1* | 2/2015 | Zakis | H04R 3/005 381/71.1 |
| 2015/0092948 | A1 | 4/2015 | Usher et al. | |
| 2015/0189423 | A1* | 7/2015 | Giannuzzi | H04R 17/02 381/74 |
| 2015/0365776 | A1 | 12/2015 | Usher et al. | |
| 2017/0171657 | A1 | 6/2017 | Liu et al. | |
| 2018/0115815 | A1* | 4/2018 | Kumar | H04R 1/1008 |
| 2018/0132048 | A1 | 5/2018 | Usher et al. | |
| 2018/0249265 | A1 | 8/2018 | Termeulen et al. | |
| 2018/0249266 | A1 | 8/2018 | Termeulen et al. | |
| 2019/0273999 | A1 | 9/2019 | Usher et al. | |
| 2019/0378491 | A1* | 12/2019 | Mohammad | G10K 11/17827 |
| 2020/0275223 | A1 | 8/2020 | Usher et al. | |

* cited by examiner

METHOD AND DEVICE FOR DETECTING WEARING STATE OF EARPHONE AND EARPHONE

CROSS-REFERENCE TO RELATED APPLICATIONS

This application claims priority to Chinese Patent Application No. 201910436304.5, filed on May 23, 2019, the entire contents of which are incorporated herein by reference.

BACKGROUND

Due to the advantages of small size, portability and the like, earphones are applied more and more extensively to daily lives. For example, earphones are used for listening to music and watching movies. Sound effects of earphones are crucial to users. Most manufacturers focus more on the quality of earphones and ignore influence of wearing states of an earphone, i.e., the states in which the earphones and ear canals are coupled, on sound effects of the earphones. If an earphone is worn loosely, coupling between the earphone and an ear canal is poor, a low frequency may leak, and a low-frequency sound effect is seriously influenced. If the earphone is worn tightly, coupling between the earphone and the ear canal is relatively good, the low frequency is maintained, and a relatively good sound effect may be provided for a user.

According to existing methods for detecting a wearing state of an earphone, a wearing state is detected by use of an amplitude of an infrasonic signal collected by a microphone according to infrasonic information in a loudspeaker; or the wearing state is detected according to a difference value between weighted sums of low-band amplitudes of an audio signal of a sound source and a feedback audio signal. These methods may have specific requirements on signals of sound sources (for example, infrasonic signals imperceptible to ears are required to be embedded into the signals of the sound sources) or these methods may have poor anti-noise performance.

SUMMARY

The disclosure relates to a method and device for detecting a wearing state of an earphone and storage medium.

According to a first aspect, the disclosure provides an earphone wearing state detection method, an earphone including a loudspeaker and a prepositive microphone and the prepositive microphone being configured to collect an audio signal played by the loudspeaker, the method including that: a source audio signal input into the loudspeaker and a feedback audio signal collected by the prepositive microphone are acquired; a transfer function between the source audio signal and the feedback audio signal is acquired according to the source audio signal and the feedback audio signal; and a wearing state of the earphone is acquired according to the transfer function, and audio compensation processing is performed on the source audio signal according to the wearing state.

According to a second aspect, the disclosure provides a device for detecting a wearing state of an earphone, an earphone including a loudspeaker and a prepositive microphone and the prepositive microphone being configured to collect an audio signal played by the loudspeaker, the device including: a signal acquisition unit, acquiring a source audio signal input into the loudspeaker and a feedback audio signal collected by the prepositive microphone; a signal calculation unit, acquiring a transfer function between the source audio signal and the feedback audio signal according to the source audio signal and the feedback audio signal; and a detection and compensation unit, acquiring a wearing state of the earphone according to the transfer function and performing audio compensation processing on the source audio signal according to the wearing state.

According to a third aspect, the disclosure provides an earphone, which may include a loudspeaker and a prepositive microphone, the prepositive microphone being configured to collect an audio signal played by the loudspeaker, and further include: a memory, storing a computer-executable instruction; and a processor, the computer-executable instruction being executed to enable the processor to execute the earphone wearing state detection method.

According to a fourth aspect, the disclosure provides a computer-readable storage medium, in which one or more computer programs may be stored, the one or more computer programs being executed to implement the earphone wearing state detection method.

DETAILED DESCRIPTION

Figure 1:
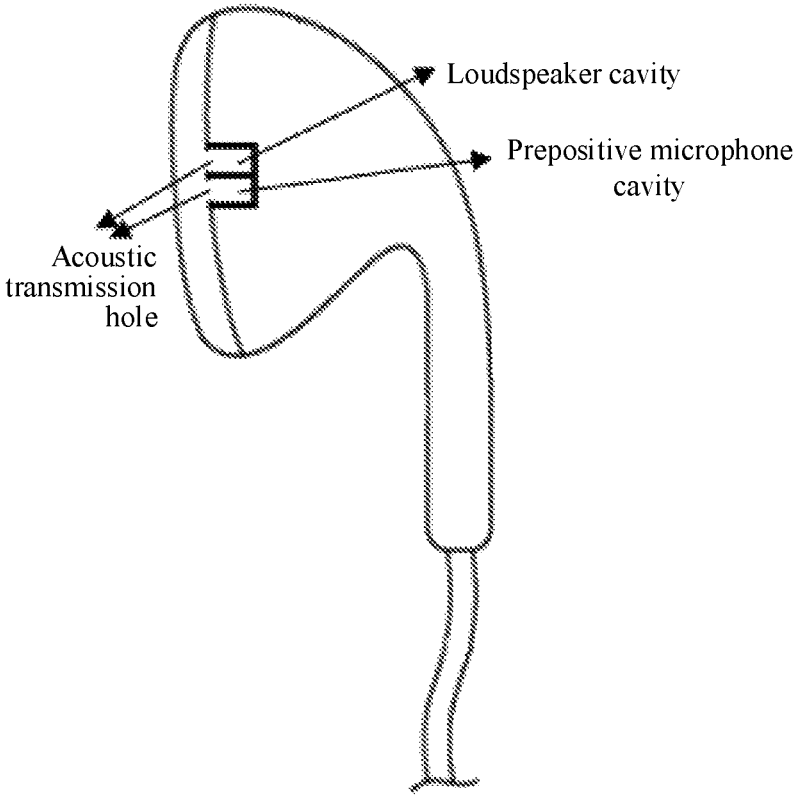
FIG. 1 is a schematic diagram of an effect of an earphone according to an embodiment of the disclosure.

Embodiments of the disclosure provide an earphone wearing state detection method. Wearing tightness is detected by use of a transfer function between a loudspeaker and prepositive microphone of an earphone, and a filter coefficient is updated according to a detection result of the wearing tightness for audio compensation for a source audio signal with an updated filter, so that the detection method is independent of an audio source, the anti-noise performance of the earphone may be improved, and the earphone may be adaptive to different sound sources. The embodiments of the disclosure also provide a corresponding device, an earphone and a computer-readable storage medium. Detailed descriptions will be made below respectively.

In order to make the purpose, technical solutions and advantages of the disclosure clearer, the implementation modes of the disclosure will further be described below in combination with the drawings in detail. However, it is to be understood that these descriptions are only exemplary and not intended to limit the scope of the disclosure. In addition, in the following descriptions, descriptions about known structures and technologies are omitted to avoid unnecessary confusion of concepts of the disclosure.

Terms are used herein not to limit the disclosure but only to describe specific embodiments. Terms "a/an", "one (kind)", "the" and the like used herein should also include meanings of "multiple" and "multiple kinds", unless otherwise clearly pointed out in the context. In addition, terms "include", "contain" and the like used herein represent existence of a feature, a step, an operation and/or a component but do not exclude existence or addition of one or more other features, steps, operations or components.

All the terms (including technical and scientific terms) used herein have meanings usually understood by those skilled in the art, unless otherwise specified. It is to be noted that the terms used herein should be explained to have meanings consistent with the context of the specification rather than explained ideally or excessively mechanically.

The drawings show some block diagrams and/or flowcharts. It is to be understood that some blocks or combinations thereof in the block diagrams and/or the flowcharts may be implemented by computer program instructions. These computer program instructions may be provided for a universal computer, a dedicated computer or a processor of another programmable data processing device, so that these instructions may be executed by the processor to generate a device for realizing functions/operations described in these block diagrams and/or flowcharts.

Therefore, the technology of the disclosure may be implemented in form of hardware and/or software (including firmware and a microcode, etc.). In addition, the technology of the disclosure may adopt a form of a computer program product in a computer-readable storage medium storing an instruction, and the computer program product may be used by an instruction execution system or used in combination with the instruction execution system. In the context of the disclosure, the computer-readable storage medium may be any medium capable of including, storing, transferring, propagating or transmitting an instruction. For example, the computer-readable storage medium may include, but not limited to, an electric, magnetic, optical, electromagnetic, infrared or semiconductor system, device, apparatus or propagation medium. Specific examples of the computer-readable storage medium include a magnetic storage device such as a magnetic tape or a Hard Disk Driver (HDD), an optical storage device such as a Compact Disc Read-Only Memory (CD-ROM), a memory such as a Random Access Memory (RAM) or a flash memory, and/or a wired/wireless communication link.

The disclosure is applied to an earphone system with a loudspeaker and a microphone. As illustrated in FIG. 1, an earphone is provided with a loudspeaker configured to play an audio signal and a prepositive microphone, and the prepositive microphone is arranged at a front end of the loudspeaker, and is configured to collect an audio signal around the loudspeaker through an acoustic transmission hole. When the earphone of the disclosure is worn in the ear of a user for audio playing, both the loudspeaker and the prepositive microphone are in the ear canal, and the audio signal collected by the prepositive microphone includes the audio signal played by the loudspeaker and a noise signal.

When the earphone is worn loosely, a cavity formed by the earphone and the ear canal is poor in tightness, and a low frequency of an output signal of the loudspeaker is easy to leak, resulting in relatively great attenuation; and when the earphone is worn tightly, the cavity formed by the earphone and the ear canal is high in tightness, and the low frequency of the output signal of the loudspeaker substantially does not leak. It can be seen that, due to different low-frequency signal energy and cavity characteristics in case of different wearing tightness, a transfer function between the loudspeaker and the prepositive microphone have apparently different characteristics.

On one hand, the transfer function is only correlated to the earphone system, for example, correlated to positions of the loudspeaker and the prepositive microphone and the cavity formed by the loudspeaker and the ear canal, so that the earphone of the disclosure may be applied to any sound source including intermediate/low-frequency information. On the other hand, cross-correlation information of two paths of signals is required by estimation of the transfer function, and an uncorrelated signal may be effectively removed through the cross-correlation information. When there is an external noise, the audio signal collected by the prepositive microphone includes a wanted signal played by the loudspeaker and an external interference signal. The audio signal collected by the prepositive microphone and played by the loudspeaker is in high correlation with an audio signal input into the loudspeaker by the earphone system, while the external noise is in low correlation with the audio signal input into the loudspeaker by the earphone system. Therefore, adopting the transfer function as a characteristic to distinguish the wearing tightness of the earphone may effectively eliminate the influence of the external noise and improve the anti-noise performance of the earphone.

Figure 2:
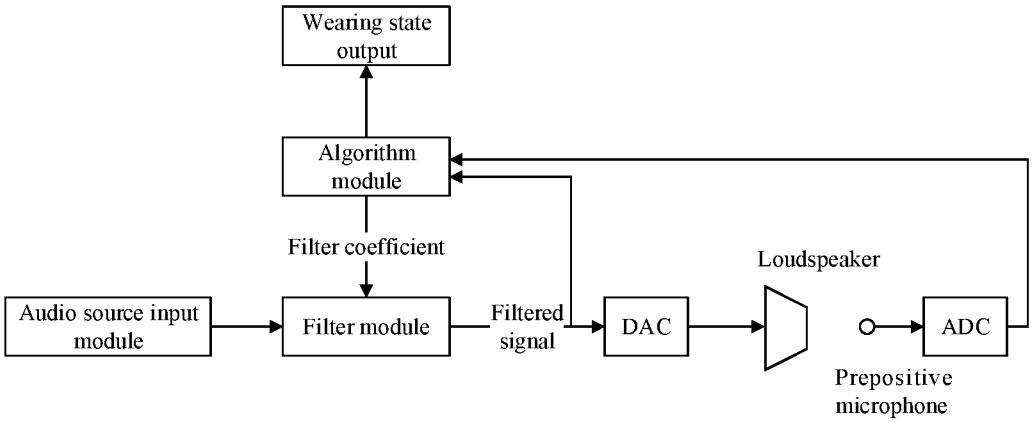
FIG. 2 is a flowchart of audio signal processing according to an embodiment of the disclosure.

Therefore, the wearing tightness is detected by use of the transfer function between the loudspeaker and the prepositive microphone in the disclosure. As illustrated in FIG. 2, the disclosure mainly involves design of an algorithm module. This part may detect a wearing state of the earphone and give some prompts to the user according to the wearing state of the earphone, for example, prompting the user that the earphone is worn loosely and a wearing angle of the earphone is required to be properly regulated or a muff is required to be replaced to achieve higher tightness of the cavity formed by the earphone and the ear canal to improve a sound effect. Furthermore, the algorithm module may be configured to detect the transfer function between an input signal and a feedback signal in a wearing process of the user, estimate a filter coefficient in combination with a set target transfer function, update a filter by use of the estimated filter coefficient and filter the source audio signal input into the loudspeaker by use of the updated filter, namely a filter module illustrated in FIG. 2, to enable the user to obtain a compensated audio signal in real time to achieve a better sound effect.

The disclosure provides an earphone wearing state detection method. In the embodiment, an earphone includes a loudspeaker and a prepositive microphone, and the prepositive microphone is configured to collect an audio signal played by the loudspeaker.

Figure 3:
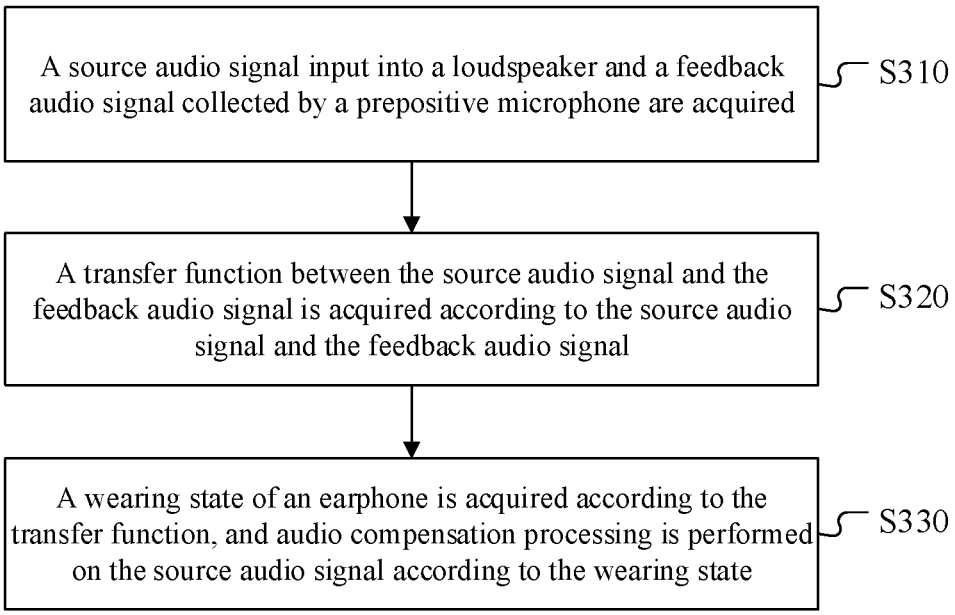
FIG. 3 is a flowchart of an earphone wearing state detection method according to an embodiment of the disclosure.

FIG. 3 is a flowchart of an earphone wearing state detection method according to an embodiment of the disclosure. As illustrated in FIG. 3, the method of the embodiment includes the following operations.

In S310, a source audio signal input into the loudspeaker and a feedback audio signal collected by the prepositive microphone are acquired.

In S320, a transfer function between the source audio signal and the feedback audio signal is acquired according to the source audio signal and the feedback audio signal.

In S330, a wearing state of the earphone is acquired according to the transfer function, and audio compensation processing is performed on the source audio signal according to the wearing state.

According to the embodiment, by use of the source audio signal input into the loudspeaker of the earphone and the feedback audio signal collected by the prepositive microphone of the loudspeaker, the transfer function between the two signals may be obtained. On one hand, the transfer function is correlated to an earphone system, for example, correlated to positions of the loudspeaker and the microphone and the tightness of a cavity formed by the loudspeaker and an ear canal, and uncorrelated to an audio signal characteristic, and on the other hand, the transfer function presents apparently different characteristics when the earphone is in a normal wearing state and an abnormal wearing state. In the embodiment, based on the two characteristics of the transfer function, the wearing state of the earphone is effectively detected by use of the transfer function to improve the anti-noise performance and make the earphone adaptive to different sound sources.

S310 to S330 will be described below in conjunction with FIGS. 1 to 8 in detail.

At first, S310 is executed, namely the source audio signal input into the loudspeaker and the feedback audio signal collected by the prepositive microphone are acquired.

According to the embodiment, totally two paths of signals are acquired. One path of signal is the source audio signal input into the loudspeaker, i.e., a source audio signal not filtered through the filter module in FIG. 2, recorded as $x=[x(0), x(1), \ldots, x(N-1)]$, and the other path of signal is a feedback audio signal sequence collected by the prepositive microphone, recorded as $y=x1+v=x1(0), x1(1), \ldots, x1(N-1)]+[v(0), v(1), \ldots, v(N-1)]$, where x1 represents an audio signal collected by the prepositive microphone and played by the loudspeaker, and v represents an external interference noise collected by the prepositive microphone. In the embodiment, high-pass filtering is also performed on the two paths of signals to eliminate the influence of a direct current signal.

After the source audio signal and the feedback audio signal are acquired, S320 is continued to be executed, namely the transfer function between the source audio signal and the feedback audio signal is acquired according to the source audio signal and the feedback audio signal.

Figure 4:
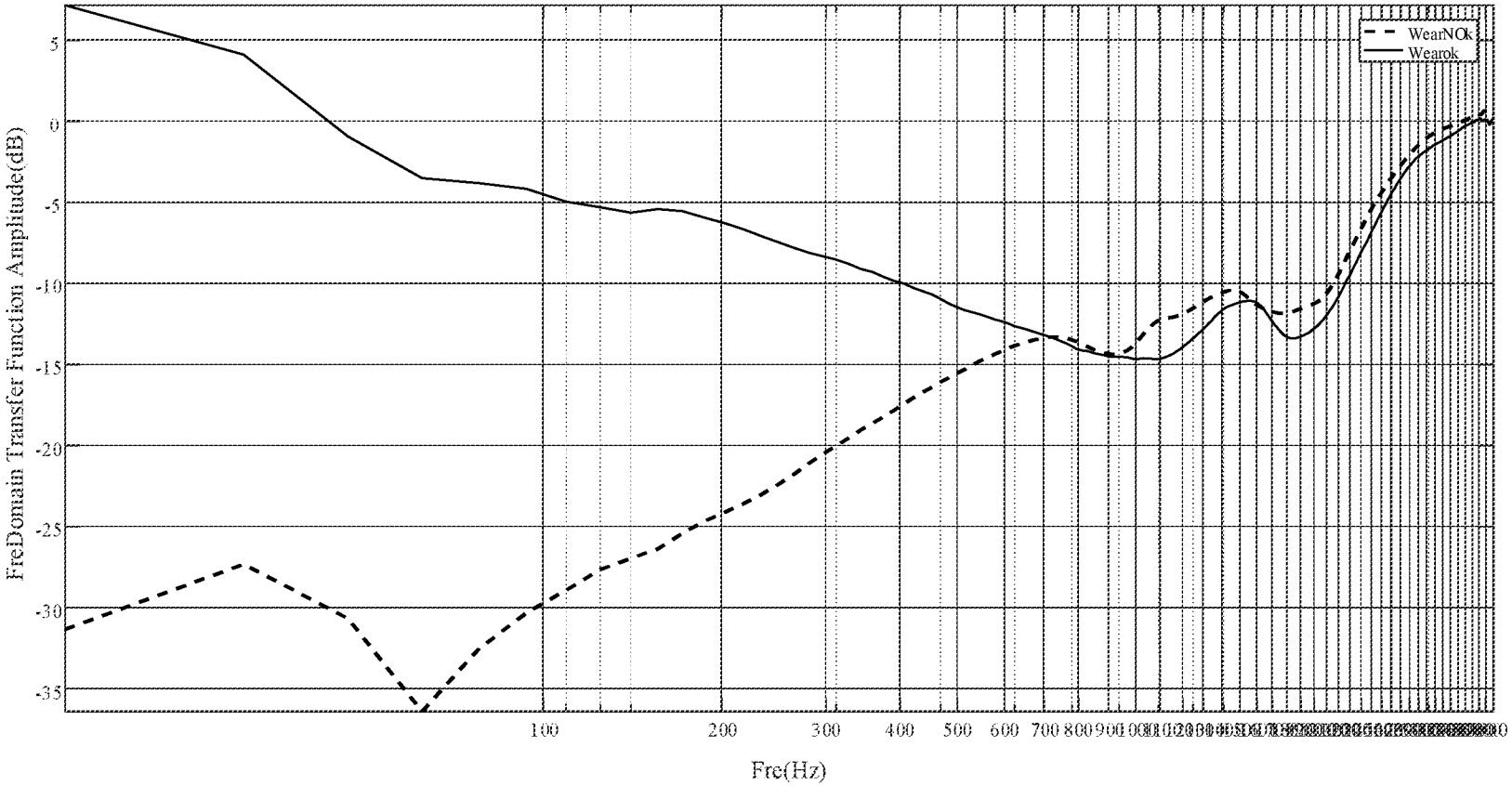
FIG. 4 is a comparison diagram of amplitude curves of frequency-domain transfer functions according to an embodiment of the disclosure.
Figure 5:
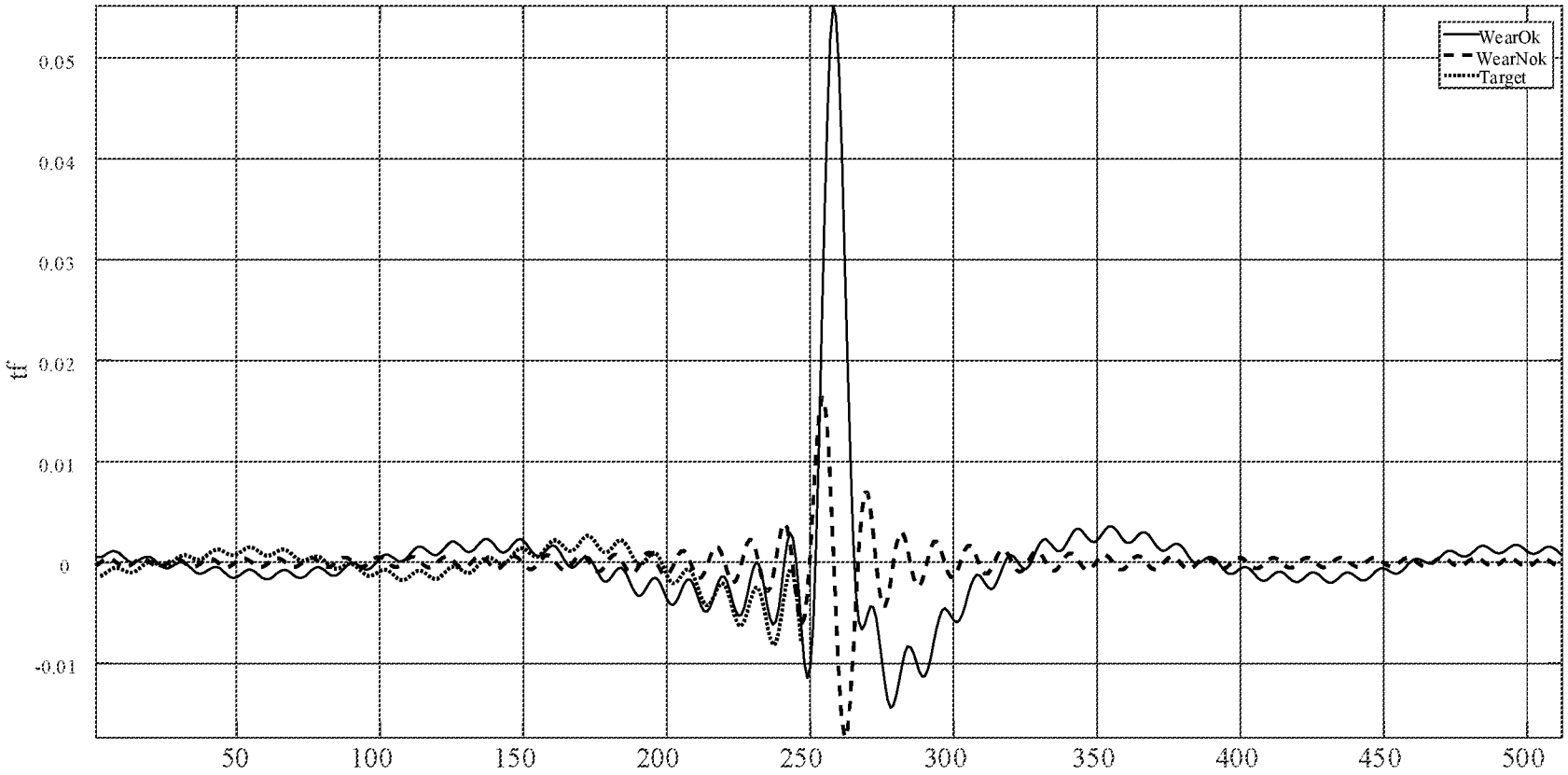
FIG. 5 is a comparison diagram of amplitude curves of time-domain transfer functions according to an embodiment of the disclosure.

Amplitudes of corresponding frequency-domain transfer functions and typical samples of corresponding time-domain transfer functions in a loose wearing state and tight wearing state of the earphone are illustrated in FIGS. 4 to 5 (in FIGS. 4 to 5, WearOk corresponds to the tight wearing state, and WearNok corresponds to the loose wearing state). It can be seen that both the frequency-domain transfer functions and time-domain transfer functions in the loose wearing state and tight wearing state of the earphone are apparently different. Referring to FIG. 4, for the amplitude of the frequency-domain transfer function, in the loose wearing state, energy in a low frequency band (100 Hz to 700 Hz) is relatively low because of low-frequency energy leakage, and on the contrary, in the tight wearing state, the energy is relatively high. Referring to FIG. 5, differences between the time-domain transfer functions in the loose wearing state and the tight wearing state and a target transfer function are apparently different, for example, Euclidean distances with the target transfer functions are apparently different. It can be clearly seen from FIG. 5 that values of the time-domain transfer function corresponding to the tight wearing state and the target transfer function at corresponding signal sampling points are closer and thus the Euclidean distance is relatively short, while values of the time-domain transfer function corresponding to the loose wearing state and the target transfer function at corresponding signal sampling points are greatly different and thus the Euclidean distance is also relatively long. It can be seen that the transfer functions present apparently different characteristics when the earphone is worn loosely and worn tightly.

After the transfer function is acquired, S330 is continued to be executed, namely the wearing state of the earphone is acquired according to the transfer function and audio compensation processing is performed on the source audio signal according to the wearing state.

Figure 6:
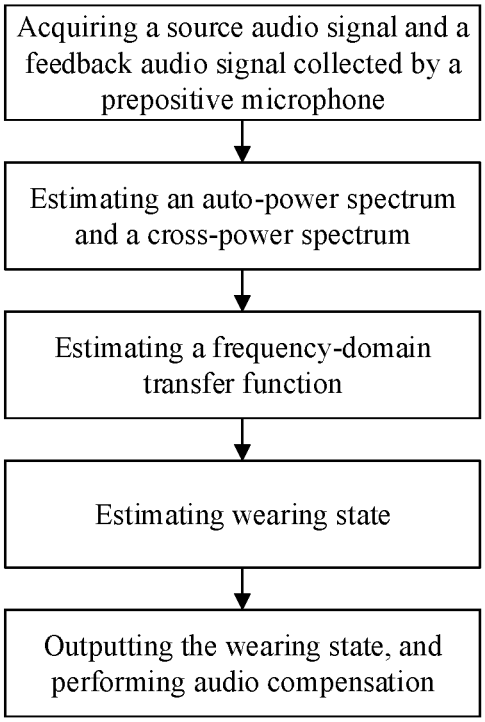
FIG. 6 is a schematic diagram of detecting a wearing state based on a frequency-domain transfer function according to an embodiment of the disclosure.

In some embodiments, as illustrated in FIG. 6, a method of detecting the wearing state of the earphone based on a frequency-domain transfer function is as follows: energy of the frequency-domain transfer function at multiple frequency points (also called frequencies Bin hereinafter) in a low frequency band is acquired, and the energy at each frequency point is compared with an energy threshold value corresponding to the frequency point; and if the energy at all or part of the frequency points in the low frequency band is greater than the corresponding energy threshold values, it is determined that the earphone is in a normal wearing state, or, if the energy at each of one or more of the frequency points is less than an energy threshold value corresponding to the frequency point, it is determined that the earphone is in an abnormal wearing state.

In such case, if the earphone is in the abnormal wearing state, a filter configured to filter the source audio signal is acquired according to the frequency-domain transfer function and the predetermined target transfer function, and the source audio signal is filtered by the filter to implement compensation for the source audio signal; and if the earphone is in the normal wearing state, a filter coefficient is set to be 0, and the source audio signal is not filtered. The target transfer function may be determined in the following manner: experiments are conducted to perform measurement for multiple persons to obtain multiple transfer functions under a tight wearing condition and averaging is performed to obtain a mean transfer function as the target transfer function, or a transfer function obtained according to a standard ear canal simulation device under a high tightness condition may be determined as the target transfer function.

Figure 7:
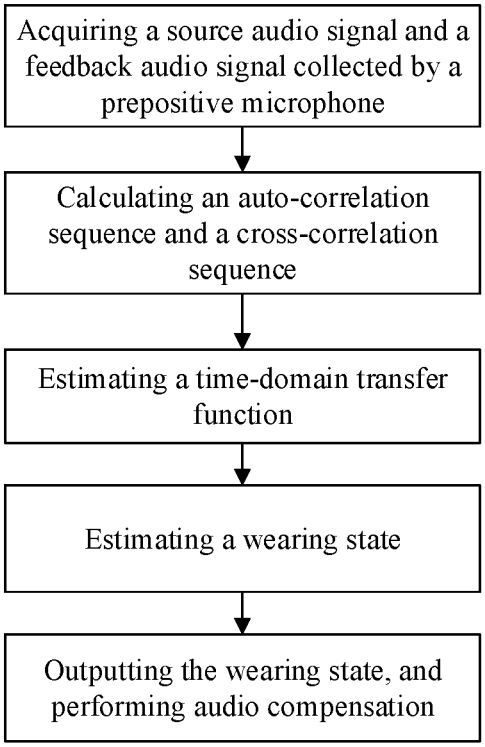
FIG. 7 is a schematic diagram of detecting a wearing state based on a time-domain transfer function according to an embodiment of the disclosure.

In some embodiments, as illustrated in FIG. 7, a method of detecting the wearing state of the earphone based on a time-domain transfer function is as follows: a Euclidean distance between the time-domain transfer function and the predetermined target transfer function at each signal sequence sampling point is acquired; and when the Euclidean distance is less than a distance threshold value, it is determined that the earphone is in the normal wearing state, and when the Euclidean distance is not less than the distance threshold value, it is determined that the earphone is in the abnormal wearing state.

In such case, if the earphone is in the abnormal wearing state, the time-domain transfer function is transformed to a frequency domain to obtain the frequency-domain transfer function, the filter configured to filter the source audio signal is acquired according to the frequency-domain transfer function and the target transfer function, and the source audio signal is filtered by the filter to implement compensation for the source audio signal; and if the earphone is in the normal wearing state, the filter coefficient is set to be 0, and the source audio signal is not filtered.

According to the embodiment, the filter coefficient is estimated by use of the transfer function, so that the earphone may be better adapted to different scenarios, for example, various audios are played in a noise environment. With adoption of the method provided in the embodiment, the wearing state of the earphone may be effectively detected, and audio compensation is performed based on the wearing state to provide a good sound effect for the user.

The normal wearing state in the embodiment can be understood as the tight wearing state of the earphone, namely the tightness of the cavity formed by the loudspeaker and the ear canal is relatively high, and a low frequency of an output signal of the loudspeaker substantially does not leak. The abnormal wearing state in the embodiment can be understood as the loose wearing state of the earphone, namely the tightness of the cavity formed by the loudspeaker and the ear canal is relatively poor, and the low frequency of the output signal of the loudspeaker greatly leaks.

In another embodiment, after the wearing state of the earphone is acquired according to the transfer function, audio compensation processing is not performed on the source audio signal according to the wearing state, and instead, the user is prompted according to the acquired wearing state. For example, a prompt tone is produced for the user, and a visual prompt is given to the user. There are no specific limits made herein.

For describing the earphone wearing state detection method of the embodiment in detail, descriptions are made through the following embodiment. That is, an earphone wearing state detection method is designed according to different characteristics presented by the transfer function in the loose wearing state and the tight wearing state. For improving the problem of low-frequency leakage in the loose wearing state, the filter coefficient is estimated according to the target transfer function and the estimated transfer function, and the source audio signal input into the loudspeaker is filtered by the filter to obtain a compensated audio signal.

As illustrated in FIG. 2, the disclosure mainly involves design of an algorithm module. This part mainly includes wearing state detection and filter coefficient estimation. Two implementations are adopted for an algorithm for wearing state detection.

One implementation is to detect the wearing state by use of the frequency-domain transfer function, and a schematic block diagram is illustrated in FIG. 6: the source audio signal and the feedback audio signal are acquired, auto-power spectrum and cross-power spectrum estimation is performed on the two audio signals, frequency-domain transfer function estimation is performed by use of an auto-power spectrum and a cross-power spectrum, the wearing state of the earphone is distinguished by use of different characteristics of the frequency-domain transfer function in the loose wearing state and the tight wearing state, and the wearing state, for example, the loose wearing state and the tight wearing state, of the earphone is output.

The other implementation is to detect the wearing state by use of the time-domain transfer function, and a schematic block diagram is illustrated in FIG. 7: the source audio signal and the feedback audio signal are acquired, autocorrelation sequences and cross-correlation sequences of the two audio signals are calculated, the time-domain transfer function is estimated by use of a criterion of minimum mean square error according to the autocorrelation sequences and the cross-correlation sequences, the wearing state of the earphone is distinguished by use of different characteristics of the time-domain transfer function in the loose wearing state and the tight wearing state, and the wearing state, for example, the loose wearing state and the tight wearing state, of the earphone is output.

Figure 8:
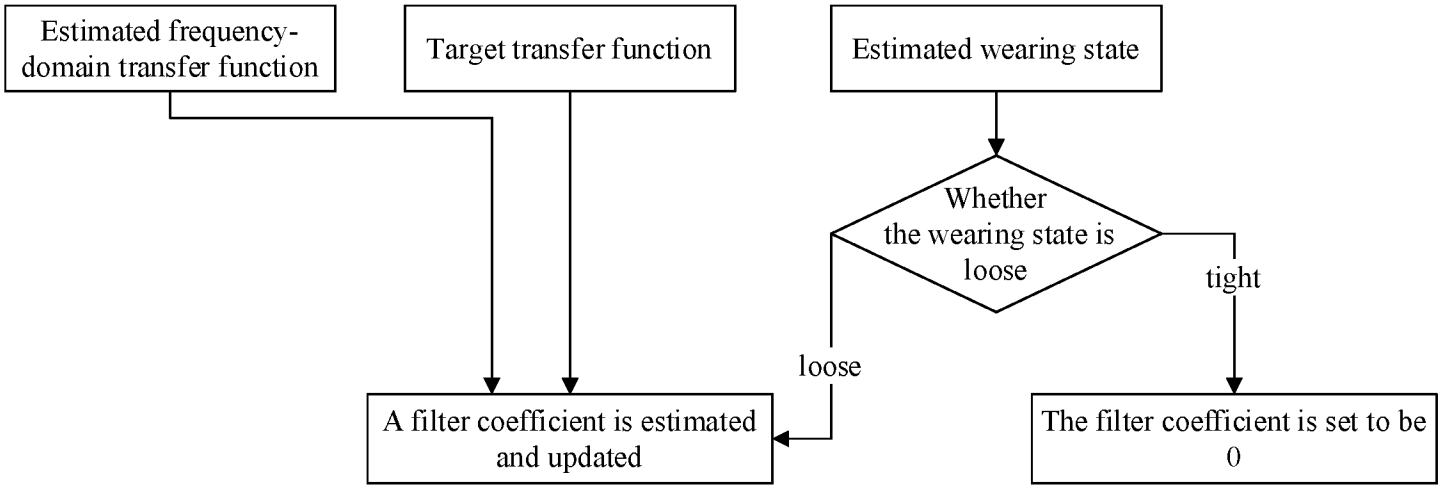
FIG. 8 is a schematic diagram of filter estimation according to an embodiment of the disclosure.

After the wearing state of the earphone is detected, some prompts may be given to the user to regulate an angle and position, etc. of the earphone. As illustrated in FIG. 8, the filter coefficient may also be updated and regulated in real time to process the source audio signal input into the loudspeaker.

Based on the abovementioned wearing state detection principles, in the embodiment, the earphone wearing state detection method is proposed based on the source audio signal and the feedback audio signal collected by the prepositive microphone, and an audio compensation method is designed according to the detection result of the wearing state.

FIG. 6 illustrates a specific implementation solution of the first wearing state detection algorithm, i.e., a frequency-domain transfer function-based estimation method. The following steps are mainly included.

In (1), an audio processing signal of a present frame is obtained. One path of signal is an source audio signal sequence input into the loudspeaker (compensation of the filter is not considered), recorded as x=[x(0), x(1), . . . , x(N−1)], and the other path of signal is the feedback audio signal sequence collected by the prepositive microphone, recorded as y=x1+v=x1(0), x1(1), . . . , x1(N−1)]+[v(0), v(1), . . . , v(N−1)], where x1 represents an audio signal collected by the prepositive microphone and played by the loudspeaker, and v represents an external interference noise collected by the prepositive microphone. Then, high-pass filtering is also performed on the two paths of signal sequences to eliminate the influence of a direct current signal.

In (2), windowing and frequency-domain transform are performed: analysis windows such as Hamming windows (w=[w(0), w(1), . . . , w(N−1)]) are added to the two paths of signals, and Fourier transform is performed to obtain frequency-domain signals, recorded as X(k) and Y(k) respectively, as illustrated in the following formulae:

$$X(k) = \sum_{n=0}^{N-1} x(n)w(n)e^{-j2\pi/N} \quad 0 <= k <= N-1,$$

and $$0 <= Y(k) = \sum_{n=0}^{N-1} \begin{pmatrix} x1(n) + \\ v(n) \end{pmatrix} w(n)e^{-j2\pi/N} = X1(k) + V(k) \quad 0 <= k <= N-1,$$

where N represents a Fourier transform point number, n represents a signal sequence sampling point, k represents sequence numbers of multiple frequency points Bin. The frequency point Bin is also called a frequency point or a frequency window.

In (3), the auto-power spectrum and the cross-power spectrum are calculated. Power spectrum estimation may be performed by use of a periodogram method, and the cross-power spectrum mainly includes correlated information components of the two paths of signals. When there is an external noise, the audio signal collected by the prepositive microphone includes a wanted signal and an external interference signal. According to a conventional method, if the loose wearing state and the tight wearing state are distinguished only by use of a frequency response of the audio signal obtained by the prepositive microphone and absolute information thereof, the detection result may inevitably be influenced by the noise. Therefore, the wearing state is considered to be distinguished by use of the transfer function including cross-power spectrum information in the embodiment. A calculation formula for the auto-power spectrum Pxx(k) of the source audio signal is as follows:

$$Pxx(k) = E[X(k)X^*(k)] = \frac{1}{N}|X(k)|^2.$$

The cross-power spectrum Pyx(k) of the feedback audio signal and the source audio signal is calculated as follows:

$$Pyx(k) = E[y(k)X^*(k)] = E[(X1(k) + V(k))X^*(k)] =$$

$$E[X1(k)X^*(k)] + E[V(k)X^*(k)] \approx E[X1(k)X^*(k)] = \frac{1}{N}X1(k)X^*(k),$$

where * represents a conjugation operator. Since the external noise v is uncorrelated to the source audio signal x input into the loudspeaker, E[V(k)X*(k)]≈0.

In (4), mean power spectrums are calculated. For effectively eliminating the influence of uncorrelated components in the two paths of signals, smoothing processing is further performed on the power spectrums in the embodiment. Mean value smoothing is permed on power spectrums in a period of time, for example, a frame with a time length LenT=30, and a mean auto-power spectrum PxxAve(k) and a mean cross-power spectrum PyxAve(k) are calculated as follows:

$$PxxAve(k) = \frac{1}{LenT}\sum_{T=1}^{LenT} P_T xx(k),$$

and $$PyxAve(k) = \frac{1}{LenT}\sum_{T=1}^{LenT} P_T yx(k),$$

where $P_T$xx(k) and $P_T$yx(k) represent the auto-power spectrum and cross-power spectrum corresponding to a moment T.

In (5), the frequency-domain transfer function $$H'(k) = \frac{PyxAve(k)}{PxxAve(k)}$$

is calculated. The frequency-domain transfer function is obtained by dividing the mean cross-power spectrum by the mean auto-power spectrum, is relative information of the two paths of signals and may be applied to any sound source including intermediate/low-frequency information.

In (6), the wearing states are distinguished by use of an amplitude of the frequency-domain transfer function. It can be seen from typical signals illustrated in FIGS. 3 to 4 that, for a low-frequency amplitude such as 100 Hz to 700 Hz, amplitude values at each frequency point in the loose wearing state and the tight wearing state are apparently different. The amplitude at each frequency point may be obtained by a statistical method. A calculation manner for the amplitude of the frequency-domain transfer function is $$|H'(k)| = \left|\frac{PyxAve(k)}{PxxAve(k)}\right|.$$

According to the embodiment, the wearing state of the earphone may be determined according to a magnitude of the energy of the frequency-domain transfer function in the low frequency band such as a low frequency band of 100 Hz to 700 Hz, the energy corresponding to each frequency Bin is statistically obtained according to Pow(k)=|H'(k)|$^2$, and the magnitude of the energy at each frequency Bin is determined.

It is assumed that the low frequency band includes M frequencies Bin and the M frequencies Bin correspond to different energy threshold values respectively. If energy corresponding to each of the M frequencies Bin is greater than the respective energy threshold value, or if the energy corresponding to each of most frequencies Bin of the M frequencies Bin is greater than the respective energy threshold value, 1 (representing the tight wearing state) is output, and otherwise 0 (representing the loose wearing state) is output.

In (7), the filter coefficient is estimated by use of the frequency-domain transfer function.

For estimation of the filter, the filter may be obtained through a mapping relationship according to the statistically obtained target transfer function represented as $H_d$(k) and the estimated frequency-domain transfer function H'(k). For example, the filter HEst(k) is obtained in a calculation manner illustrated in the formula $$HEst(k) = \frac{|H_d(k)|}{|H'(k)|}.$$

Since human ears are insensitive to phases and more sensitive to amplitudes, compensation processing may be considered to be performed on the amplitude only. If the detection result is tight wearing, namely an output tag is 1, the filter coefficient may be set to be 0, and the source audio signal is not filtered. If the detection result is loose wearing, namely the output tag is 0, the source audio signal is filtered by use of HEst(k) to obtain the compensated signal XFilt (k)=HEst(k)·X(k).

Through Steps (1) to (7), the wearing state of the earphone may be effectively detected, and a source audio is compensated based on the detection result to improve the sound effect of the earphone.

FIG. 7 illustrates a specific implementation solution of the second wearing state detection algorithm, i.e., a time-domain transfer function-based estimation method. The following steps are mainly included.

In (1), an audio processing signal of a present frame is obtained. One path of signal is an source audio signal sequence input into the loudspeaker (compensation of the filter is not considered), recorded as x=[x(0), x(1), . . . , x(N−1)], and the other path of signal is the feedback audio signal sequence collected by the prepositive microphone, recorded as y=x1+v=x1(0), x1(1), . . . , x1(N−1)], where x1 represents an audio signal collected by the prepositive microphone and played by the loudspeaker, and v represents an external interference noise collected by the prepositive microphone. Then, high-pass filtering is also performed on the two paths of signal sequences to eliminate the influence of a direct current signal.

In (2), a normalized auto-correlation sequence $r_{xx}(l)$ of the source audio signal is calculated, and a normalized cross-correlation sequence $r_{yx}(l)$ between the feedback audio signal and the source audio signal is calculated. The following calculation manner may be adopted:

$$r_{xx}(l) = \frac{1}{N}\sum_{n=l}^{N-1} x(n)x(n-l),$$

and $$r_{yx}(l) = \frac{1}{N}\sum_{n=l}^{N-1} y(n)x(n-l) = \frac{1}{N}\sum_{n=l}^{N-1} (x1(n)+v(n))x(n-l) = \frac{1}{N}\sum_{n=l}^{N-1} x1(n)x(n-l) + \frac{1}{N}\sum_{n=l}^{N-1} v(n)x(n-l) = r_{x1x}(l) + r_{vx}(l),$$

where l is a length of the signal, and $\mu_v$, $\mu_x$ represent statistical mean values of the external noise and the source audio signal respectively. If the external noise and the source audio signals are signals of which the statistical mean values are 0, $\mu_v=0$, $\mu_x=0$, and a cross-correlation of the two independent and uncorrelated signals meets $r_{vx}\approx\mu_v\mu_x=0$, so that the cross-correlation mainly includes correlated information of the two paths of signals and has an inhibition effect on correlated information.

In (3), for a system, according to a criterion of minimum mean square error of an optimal coefficient, a cross-correlation $r_{yx}(l)$ of an output and an input may be obtained by convolution of an auto-correlation $r_{xx}(l)$ of an input signal and a system transfer function h(l), and the following relationship may be obtained:

$$r_{yx}(l) = h(l)^* r_{xx}(l) = \sum_{k=0}^{N-1} h(k) r_{xx}(l-k),\ l = 0, 1, \ldots, N-1.$$

It can be seen from the formula that a time-domain transfer function of the system may be calculated according to the auto-correlation and the cross-correlation, and a filter coefficient of the time-domain transfer function may be estimated as:

$$h' = \Gamma_N^{-1}\gamma_{yx},$$

where h' represents a coefficient vector, $$\Gamma_N = \begin{bmatrix} r_{xx}(0) & r_{xx}(1) & \ldots & r_{xx}(N-1) \\ r_{xx}(1) & r_{xx}(0) & \ldots & r_{xx}(N-2) \\ r_{xx}(2) & r_{xx}(1) & \ldots & r_{xx}(N-3) \\ \ldots & \ldots & \ldots & \ldots \\ r_{xx}(N-1) & r_{xx}(N-2) & \ldots & r_{xx}(0) \end{bmatrix}$$

represents an N×N toeplitz matrix, and $\gamma_{yx}=\lfloor r_{yx}(0)\ r_{yx}(1)\ \ldots\ r_{yx}(N-1)\rfloor$ is and N×1 cross-correlation vector of which an element is $\gamma_{yx}(l)$.

It can be seen from the calculation formula for the time-domain transfer function of the system that the time-domain transfer function includes information of the cross-correlation. The cross-correlation mainly includes the correlated information of the two paths of signals and has the inhibition effect on the uncorrelated information. Therefore, like the frequency-domain transfer function, the time-domain transfer function may also effectively inhibit the interference of the external noise. Moreover, the time-domain transfer function also represents the acoustic system and has no specific requirement on the audio source.

In (4), the wearing state is distinguished by use of the Euclidean distance between the frequency-domain transfer function and the target transfer function. The target transfer function $h_d$ is a transfer function corresponding to the condition that the earphone is coupled to the ear canal well. The target transfer function may be obtained in the following manner: the target transfer function may be statistically obtained according to a large number of corresponding transfer functions when different persons tightly wear the earphone; or a transfer function obtained under the condition that the tightness of the earphone and an ear canal simulator is determined as the target transfer function. The Euclidean distance d between the time-domain transfer function h' and the target transfer function $h_d$ at each signal sequence sampling point is calculated according to $$d = \sqrt{\sum_{i=1}^{N} (h_d(i) - h(i))^2},$$

if the Euclidean distance d is less than a distance threshold value TH, it is determined that a present wearing state of the earphone is the tight wearing state and the output tag is 1, otherwise it is determined that the present wearing state of the earphone is the loose wearing state and the output tag is 0.

In (5), the filter coefficient is estimated based on the time-domain transfer function. The time-domain transfer function may be transformed to the frequency domain, then the filter coefficient is calculated by use of the abovementioned method for estimating the filter coefficient in the frequency domain, and audio compensation is performed on the source audio signal by use of the updated filter coefficient.

Through Steps (1) to (5), the wearing state of the earphone may be effectively detected, and a source audio is compensated based on the detection result to improve the sound effect of the earphone.

The disclosure also provides a device for detecting a wearing state of an earphone. In the embodiment, an earphone includes a loudspeaker and a prepositive microphone of the loudspeaker, and the prepositive microphone is configured to collect an audio signal played by the loudspeaker.

Figure 9:
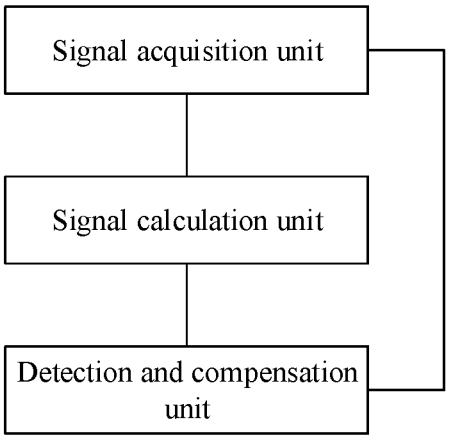
FIG. 9 is a structure block diagram of a device for detecting a wearing state of an earphone according to an embodiment of the disclosure.

FIG. 9 is a structure block diagram of a device for detecting a wearing state of an earphone according to an embodiment of the disclosure. As illustrated in FIG. 9, the device of the embodiment includes a signal acquisition unit, a signal calculation unit and a detection and compensation unit.

The signal acquisition unit acquires a source audio signal input into the loudspeaker and a feedback audio signal collected by the prepositive microphone.

The signal calculation unit acquires a transfer function between the source audio signal and the feedback audio signal according to the source audio signal and the feedback audio signal.

The detection and compensation unit acquires a wearing state of the earphone according to the transfer function and performs audio compensation processing on the source audio signal according to the wearing state.

In some embodiments, the detection and compensation unit includes a first detection module, a second detection module, a first compensation module and a second compensation module.

The first detection module acquires energy of a frequency-domain transfer function at multiple frequency points in a low frequency band, compares the energy at each frequency point and an energy threshold value corresponding to the frequency point, if the energy at each of all or part of the frequency points is greater than an energy threshold value corresponding to the frequency point, determines that the earphone is in a normal wearing state and, if the energy at each of one or more of the frequency points is less than an energy threshold value corresponding to the frequency point, determines that the earphone is in an abnormal wearing state.

Correspondingly, the first compensation module, if the earphone is in the abnormal wearing state, acquires a filter configured to filter the source audio signal according to the frequency-domain transfer function and a predetermined target transfer function and filters the source audio signal by the filter to implement compensation for the source audio signal, and if the earphone is in the normal wearing state, set a filter coefficient to be 0 and does not filter the source audio signal.

The second detection module acquires a Euclidean distance between a time-domain transfer function and the predetermined target transfer function at each signal sequence sampling point, when the Euclidean distance is less than a distance threshold value, determines that the earphone is in the normal wearing state and, when the Euclidean distance is not less than the distance threshold value, determines that the earphone is in the abnormal wearing state.

Correspondingly, the second compensation module, if the earphone is in the abnormal wearing state, transforms the time-domain transfer function to a frequency domain to obtain the frequency-domain transfer function, acquires the filter configured to filter the source audio signal according to the frequency-domain transfer function and the target transfer function and filters the source audio signal by the filter to implement compensation for the source audio signal, and if the earphone is in the normal wearing state, set the filter coefficient to be 0 and does not filter the source audio signal.

In some embodiments, the signal calculation unit includes a first calculation module and a second calculation module.

The first calculation module performs high-pass filtering on the source audio signal and the feedback audio signal respectively, transforms the high-pass filtered source audio signal and the high-pass filtered feedback audio signal to the frequency domain, obtains an auto-power spectrum of the source audio signal by use of a spectrum estimation method, obtains a cross-power spectrum of the source audio signal and the feedback audio signal, performs smoothing processing on the auto-power spectrum and the cross-power spectrum respectively and obtains the frequency-domain transfer function by use of the auto-power spectrum and cross-power spectrum subjected to smoothing processing.

The second calculation module performs high-pass filtering on the source audio signal and the feedback audio signal respectively, obtains a normalized auto-correlation sequence of the source audio signal and a normalized cross-correlation sequence of the source audio signal and the feedback audio signal according to the high-pass filtered source audio signal and the high-pass filtered feedback audio signal, and obtains the time-domain transfer function according to a criterion of minimum mean square error and by use of the normalized auto-correlation sequence and the normalized cross-correlation sequence.

The device embodiment substantially corresponds to the method embodiment and thus related parts refer to part of the descriptions about the method embodiment. The above-described device embodiment is only schematic. The units described as separate parts may or may not be physically separated, and parts displayed as units may or may not be physical units, and namely may be located in the same place, or may also be distributed to multiple network units. Part or all of the modules may be selected to achieve the purpose of the solutions of the embodiments according to a practical requirement. Those of ordinary skill in the art can understood and implement the disclosure without creative work.

The disclosure also provides an earphone.

Figure 10:
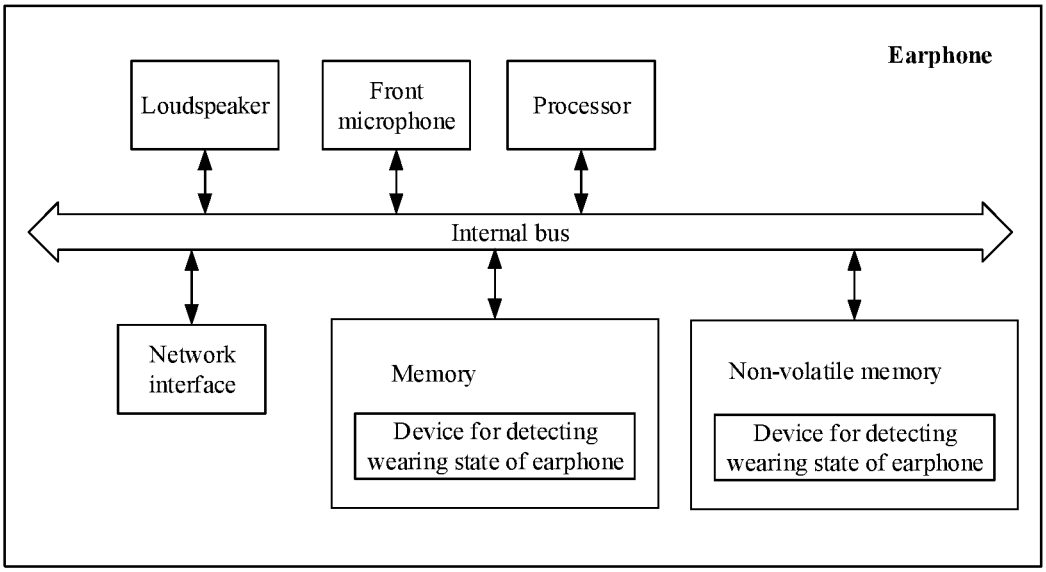
FIG. 10 is a structure diagram of an earphone according to an embodiment of the disclosure.

FIG. 10 is a structure diagram of an earphone according to an embodiment of the disclosure. As illustrated in FIG. 10, on the hardware level, the earphone includes a loudspeaker and a prepositive microphone, and the prepositive microphone is configured to collect an audio signal played by the loudspeaker. The earphone further includes a processor and a memory, and optionally, further includes an internal bus and a network interface. The memory may include a memory, for example, a high-speed RAM, and may also include a non-volatile memory, for example, at least one disk memory. Of course, the earphone may further include other hardware required by services, for example, an analog-to-digital converter.

The processor, the network interface and the memory may be connected with one another through the internal bus. The internal bus may be an Industry Standard Architecture (ISA) bus, a Peripheral Component Interconnect (PCI) bus or an Extended ISA (EISA) bus, etc. The bus may be divided into an address bus, a data bus, a control bus and the like. For convenient representation, only one double sided arrow is adopted for representation in FIG. 10, but it is not indicated that there is only one bus or one type of bus.

The memory is configured to store a program. Specifically, the program may include a program code and the program code includes a computer-executable instruction. The memory may include a memory and a non-volatile memory and provides an instruction and data for the processor.

The processor reads the corresponding computer program into the Memory from the non-volatile memory and then runs it to form a device for detecting a wearing state of an earphone on the logic level. The processor executes the program stored in the memory to implement the above-described earphone wearing state detection method.

The method executed by the earphone wearing state detection device disclosed in the embodiment illustrated in FIG. 10 in the specification may be applied to the processor or implemented by the processor. The processor may be an integrated circuit chip with a signal processing capability. In an implementation process, each step of the above-described earphone wearing state detection method may be completed by an integrated logic circuit of hardware in the processor or an instruction in a software form. The processor may be a universal processor, including a Central Processing Unit (CPU), a Network Processor (NP) and the like, and may also be a Digital Signal Processor (DSP), an Application Specific Integrated Circuit (ASIC), a Field-Programmable Gate Array (FPGA) or another programmable logic device, a discrete gate or transistor logic device and a discrete hardware component. Each method, step and logical block diagram disclosed in the embodiment of the specification may be implemented or executed. The universal processor may be a microprocessor or the processor may also be any conventional processor and the like. The steps of the method disclosed in combination with the embodiment of the specification may be directly embodied to be executed and completed by a hardware decoding processor or executed and completed by a combination of hardware and software modules in the decoding processor. The software module may be located in a mature storage medium in this field such as a RAM, a flash memory, a read-only memory, a programmable read-only memory or electrically erasable programmable read-only memory and a register. The storage medium is located in the memory, and the processor reads information in the memory and completes the steps of the earphone wearing state detection method in combination with the hardware.

The disclosure also provides a computer-readable storage medium.

The computer-readable storage medium stores one or more computer programs, the one or more computer programs include instructions, and the instructions may be executed to implement the above-described earphone wearing state detection method.

For clearly describing the technical solutions of the embodiments of the disclosure, in the embodiments of the disclosure, terms "first", "second" and the like are adopted to distinguish the same items with substantially the same functions and actions or similar items. Those skilled in the art should know that the terms "first", "second" and the like are not intended to limit the number and the execution sequence.

The above is only the specific implementations of the disclosure. Under the teaching of the disclosure, those skilled in the art may make other improvements or transformations based on the embodiments. Those skilled in the art shall know that the above specific descriptions are made only for the purpose of explaining the disclosure better and the scope of protection of the disclosure should be subject to the scope of protection of the claims.

The invention claimed is:

1. A method for detecting a wearing state of an earphone, the earphone comprising a loudspeaker and a prepositive microphone configured to collect an audio signal played by the loudspeaker, the method comprising:

acquiring a source audio signal input into the loudspeaker and a feedback audio signal collected by the prepositive microphone;

acquiring a transfer function between the source audio signal and the feedback audio signal according to the source audio signal and the feedback audio signal; and acquiring the wearing state of the earphone according to the transfer function, and performing audio compensation processing on the source audio signal according to the wearing state, wherein the transfer function is a time-domain transfer function, and acquiring the wearing state of the earphone according to the transfer function comprises:

acquiring a Euclidean distance between the time-domain transfer function and a predetermined target transfer function at each signal sequence sampling point; and when the Euclidean distance is less than a distance threshold value, determining that the earphone is in the normal wearing state, and when the Euclidean distance is not less than the distance threshold value, determining that the earphone is in the abnormal wearing state, and wherein performing audio compensation processing on the source audio signal according to the wearing state comprises:

if the earphone is in the abnormal wearing state, transforming the time-domain transfer function to the frequency domain to acquire the frequency-domain transfer function, acquiring the filter configured to filter the source audio signal according to the frequency-domain transfer function and the target transfer function, and filtering the source audio signal through the filter to implement compensation for the source audio signal.

2. The method of claim 1, wherein acquiring the transfer function between the source audio signal and the feedback audio signal according to the source audio signal and the feedback audio signal comprises:

performing high-pass filtering on the source audio signal and the feedback audio signal respectively;

transforming the high-pass filtered source audio signal and the high-pass filtered feedback audio signal to the frequency domain, obtaining an auto-power spectrum of the source audio signal by use of a spectrum estimation method, and obtaining a cross-power spectrum of the source audio signal and the feedback audio signal; and performing smoothing processing on the auto-power spectrum and the cross-power spectrum respectively, and obtaining the frequency-domain transfer function by use of the auto-power spectrum and cross-power spectrum subjected to smoothing processing.

3. The method of claim 1, wherein acquiring the transfer function between the source audio signal and the feedback audio signal according to the source audio signal and the feedback audio signal comprises:

performing high-pass filtering on the source audio signal and the feedback audio signal respectively;

obtaining a normalized auto-correlation sequence of the source audio signal and a normalized cross-correlation sequence of the source audio signal and the feedback audio signal according to the high-pass filtered source audio signal and the high-pass filtered feedback audio signal; and obtaining the time-domain transfer function according to a criterion of minimum mean square error and by use of the normalized auto-correlation sequence and the normalized cross-correlation sequence.

4. The method of claim 1, wherein after the wearing state of the earphone is acquired according to the transfer function, audio compensation processing is not performed on the source audio signal according to the wearing state, but a user is prompted according to the acquired wearing state.

5. A device for detecting a wearing state of an earphone, the earphone comprising a loudspeaker and a prepositive microphone configured to collect an audio signal played by the loudspeaker, the device comprising:

a memory, storing computer-executable instructions; and a processor, the computer-executable instructions being executed to enable the processor to execute:

acquiring a source audio signal input into the loudspeaker and a feedback audio signal collected by the prepositive microphone;

acquiring a transfer function between the source audio signal and the feedback audio signal according to the source audio signal and the feedback audio signal; and acquiring the wearing state of the earphone according to the transfer function and performing audio compensation processing on the source audio signal according to the wearing state, wherein the transfer function is a time-domain transfer function, and acquiring the wearing state of the earphone according to the transfer function comprises:

acquiring a Euclidean distance between the time-domain transfer function and a predetermined target transfer function at each signal sequence sampling point; and when the Euclidean distance is less than a distance threshold value, determining that the earphone is in the normal wearing state, and when the Euclidean distance is not less than the distance threshold value, determining that the earphone is in the abnormal wearing state, and wherein performing audio compensation processing on the source audio signal according to the wearing state comprises:

if the earphone is in the abnormal wearing state, transforming the time-domain transfer function to the frequency domain to acquire the frequency-domain transfer function, acquiring the filter configured to filter the source audio signal according to the frequency-domain transfer function and the target transfer function, and filtering the source audio signal through the filter to implement compensation for the source audio signal.

6. The device of claim 5, wherein acquiring the transfer function between the source audio signal and the feedback audio signal according to the source audio signal and the feedback audio signal comprises:

performing high-pass filtering on the source audio signal and the feedback audio signal respectively;

transforming the high-pass filtered source audio signal and the high-pass filtered feedback audio signal to the frequency domain, obtaining an auto-power spectrum of the source audio signal by use of a spectrum estimation method, and obtaining a cross-power spectrum of the source audio signal and the feedback audio signal; and performing smoothing processing on the auto-power spectrum and the cross-power spectrum respectively, and obtaining the frequency-domain transfer function by use of the auto-power spectrum and cross-power spectrum subjected to smoothing processing.

7. The device of claim 5, wherein acquiring the transfer function between the source audio signal and the feedback audio signal according to the source audio signal and the feedback audio signal comprises:

performing high-pass filtering on the source audio signal and the feedback audio signal respectively;

obtaining a normalized auto-correlation sequence of the source audio signal and a normalized cross-correlation sequence of the source audio signal and the feedback audio signal according to the high-pass filtered source audio signal and the high-pass filtered feedback audio signal; and obtaining the time-domain transfer function according to a criterion of minimum mean square error and by use of the normalized auto-correlation sequence and the normalized cross-correlation sequence.

8. The device of claim 5, wherein after the wearing state of the earphone is acquired according to the transfer function, audio compensation processing is not performed on the source audio signal according to the wearing state, but a user is prompted according to the acquired wearing state.

9. A non-transitory computer-readable storage medium having stored thereon one or more computer programs that when executed by a processor, implement a method for detecting a wearing state of an earphone, the earphone comprising a loudspeaker and a prepositive microphone configured to collect an audio signal played by the loudspeaker, the method comprising:

acquiring a source audio signal input into the loudspeaker and a feedback audio signal collected by the prepositive microphone;

acquiring a transfer function between the source audio signal and the feedback audio signal according to the source audio signal and the feedback audio signal; and acquiring the wearing state of the earphone according to the transfer function, and performing audio compensation processing on the source audio signal according to the wearing state, wherein the transfer function is a time-domain transfer function, and acquiring the wearing state of the earphone according to the transfer function comprises:

acquiring a Euclidean distance between the time-domain transfer function and a predetermined target transfer function at each signal sequence sampling point; and when the Euclidean distance is less than a distance threshold value, determining that the earphone is in the normal wearing state, and when the Euclidean distance is not less than the distance threshold value, determining that the earphone is in the abnormal wearing state, and wherein performing audio compensation processing on the source audio signal according to the wearing state comprises:

if the earphone is in the abnormal wearing state, transforming the time-domain transfer function to the frequency domain to acquire the frequency-domain transfer function, acquiring the filter configured to filter the source audio signal according to the frequency-domain transfer function and the target transfer function, and filtering the source audio signal through the filter to implement compensation for the source audio signal.

* * * * *